US010926285B2

(12) United States Patent
Risi

(10) Patent No.: US 10,926,285 B2
(45) Date of Patent: Feb. 23, 2021

(54) METHOD FOR IMPREGNATION OF WOOD COMPONENT WITH SOLID PARAFFIN WAX, APPARATUS THEREFOR AND WOOD COMPONENT SO IMPREGNATED

(71) Applicant: PROLAM, SOCIÉTÉ EN COMMANDITE, Cap St-Ignace (CA)

(72) Inventor: Benoit Risi, Cap St-Ignace (CA)

(73) Assignee: PROLAM, SOCIÉTÉ EN COMMANDITE, Cap St-Ignace (CA)

( * ) Notice: Subject to any disclaimer, the term of this patent is extended or adjusted under 35 U.S.C. 154(b) by 123 days.

(21) Appl. No.: 15/595,627

(22) Filed: May 15, 2017

(65) Prior Publication Data

US 2017/0246653 A1 Aug. 31, 2017

Related U.S. Application Data

(62) Division of application No. 12/463,005, filed on May 8, 2009, now Pat. No. 9,682,493.

(Continued)

(51) Int. Cl.

*B05D 7/06* (2006.01)
*B05C 3/18* (2006.01)

(Continued)

(52) U.S. Cl.

CPC ..... *B05C 3/18* (2013.01); *B05C 3/10* (2013.01); *B27K 3/0242* (2013.01); *B27K 3/04* (2013.01);

(Continued)

(58) Field of Classification Search

CPC .... B05C 3/18; B05C 3/10; B05C 9/08; B05C 9/14; B27K 3/0242; B27K 3/04;

(Continued)

(56) References Cited

U.S. PATENT DOCUMENTS 1,612,102 A 12/1926 Drefahl
2,031,973 A 2/1936 Mudge et al.

(Continued)

FOREIGN PATENT DOCUMENTS

DE 10 2004 020 729 A1 11/2004
EP 0 326 919 A2 8/1989

(Continued)

OTHER PUBLICATIONS

"Anthropogenic sources,", Wikipedia.org 1 page.

(Continued)

*Primary Examiner* — Hai Y Zhang
(74) *Attorney, Agent, or Firm* — Merchant & Gould P.C.

(57) ABSTRACT

A method for treating a piece of wood impregnates the piece of wood with a water repellent, wherein the water repellent is solid at ambient temperatures. The method includes the steps of providing a piece of wood to be treated; heating the piece of wood for a predetermined period of time, the piece of wood being heated at a temperature A; subsequently immersing at least a portion of the piece of wood in a bath of liquefied water repellent, the bath being at a temperature B, for a predetermined period of time. Thereafter the piece of wood is removed from the bath and allowed to cool. The temperature A is above 100° C. and the temperature B is below 100° C. but above a liquefying point for the water repellent, and a differential between temperatures A and B is at least 60° C.

8 Claims, 6 Drawing Sheets

Related U.S. Application Data

(60) Provisional application No. 61/051,717, filed on May 9, 2008.

(51) Int. Cl.

| | |
|---|---|
| ***B05C 3/10*** | (2006.01) |
| ***B27K 3/04*** | (2006.01) |
| ***B27K 3/36*** | (2006.01) |
| ***B27K 3/02*** | (2006.01) |
| *B05C 9/14* | (2006.01) |
| *B05C 9/08* | (2006.01) |
| *B27K 3/34* | (2006.01) |

(52) U.S. Cl.
CPC ..... *B27K 3/36* (2013.01); *B05C 9/08* (2013.01); *B05C 9/14* (2013.01); *B27K 3/34* (2013.01); *Y10T 428/662* (2015.04)

(58) Field of Classification Search
CPC ..... B27K 3/36; B27K 3/34; Y10T 428/662; B05D 5/00; B05D 7/06; B05D 2203/00
See application file for complete search history.

(56) References Cited

U.S. PATENT DOCUMENTS

| | | | | |
|---|---|---|---|---|
| 2,047,170 | A | 7/1936 | Asplund | |
| 2,907,684 | A | 10/1959 | Partansky | |
| 3,416,933 | A | 12/1968 | Nicholson et al. | |
| 3,928,677 | A * | 12/1975 | Anthony | B27K 3/0221 44/519 |
| 4,323,602 | A | 4/1982 | Parker | |
| 4,404,239 | A | 9/1983 | Grunewalder | |
| 4,518,394 | A | 5/1985 | Templin et al. | |
| 4,612,255 | A | 9/1986 | Hein | |
| 4,657,789 | A | 4/1987 | Lars | |
| 4,971,840 | A | 11/1990 | Boho et al. | |
| 5,679,191 | A | 10/1997 | Robinson | |
| 6,596,063 | B2 | 7/2003 | Rettenbacher et al. | |
| 6,821,631 | B2 | 11/2004 | Grantham et al. | |
| 7,264,886 | B2 | 9/2007 | Cui et al. | |
| 7,297,193 | B1 | 11/2007 | Ashmore et al. | |
| 2002/0189491 | A1 * | 12/2002 | Rettenbacher | B27K 3/34 106/15.05 |
| 2003/0104135 | A1 | 6/2003 | Grantham et al. | |
| 2003/0189039 | A1 | 10/2003 | Vinden et al. | |
| 2007/0037001 | A1 | 2/2007 | Gao et al. | |
| 2008/0263890 | A1 * | 10/2008 | Picard | B30B 15/34 34/282 |

FOREIGN PATENT DOCUMENTS

| | | | | |
|---|---|---|---|---|
| FR | 2 116 774 | A | 7/1972 | |
| GB | 482407 | A * | 3/1938 | B27K 5/02 |
| GB | 2 233 677 | A | 1/1991 | |
| JP | 55-64502 | A | 5/1980 | |
| JP | 58-42411 | A | 3/1983 | |
| JP | 4-319401 | A | 11/1992 | |
| JP | 5-237813 | A | 9/1993 | |
| KR | 10-0650347 | B1 | 11/2006 | |
| RU | 2 103 163 | C1 | 1/1998 | |
| WO | 03/037532 | A1 | 5/2003 | |
| WO | 2005/097443 | A2 | 10/2005 | |

OTHER PUBLICATIONS

EPO translation of FR 2 116 774, Raymond Mathevet, 1972.
Forest Products Laboratory, 1999 Wood Handbook-Wood as an engineering material: Gen. Tech. Rep. FPL-GTR-114, Madison, WI; U.S. Department of Agriculture, Forest Services; Citing Chapter 14: Wood Preservation, pp. 14-1 to 14-27.
"Industrial Emissions, Integration, The VOC Solvents Emissions Directive," European Commission, pp. 1-2, (printed Apr. 22, 2013).
Machine translation of KR 10-0650347, "Coating Method of Timber-Frame for a Truck Loading Bay and Timber Frame", Inventor Ho Kim, Registration Date Nov. 21, 2006.
"Standard Test Method for Qualitative Tests for the Presence of Water Repellents and Preservatives in Wood Products," ASTM International, pp. 1-2 (2008).
"The Government of Canada Takes Action to Reduce VOC Emissions from the Architectural Coatings Sector," Environment Canada, pp. 1-2, (printed Apr. 22, 2013).
The Practical Mechanics Journal; "Protecting Metallic and Other Substances" by John Stenhouse, pp. 160-161, Sep. 1, 2862.
"Toluene," Technology Transfer Network Air Toxics Web Site, 1 page (printed Apr. 19, 2013).
"Volatile Organic Compounds," U.S. Environmental Protection Agency, pp. 1-3.
"Wood Handbook: Wood as an Engineering Material", General Technical Report FPL-GRT-113, United States Department of Agriculture, pp. 3-15, 15-6 to15-10.

* cited by examiner

Diagram #1 Quantity of paraffin impregnated related to the cycle time.

Diagram #2 Zoom on the soaked part of the floor during the treatment

METHOD FOR IMPREGNATION OF WOOD COMPONENT WITH SOLID PARAFFIN WAX, APPARATUS THEREFOR AND WOOD COMPONENT SO IMPREGNATED

This application is a Division of U.S. application Ser. No. 12/463,005, filed May 8, 2009, which claims benefit of U.S. application Ser. No. 61/051,717, filed May 9, 2008, and which applications are incorporated herein by reference. To the extent appropriate, a claim of priority is made to each of the above disclosed applications.

FIELD OF THE INVENTION

The present invention is directed to a method for the impregnation of a wood component with solid paraffin wax. More specifically, the invention proposes to use 100% solid paraffin as a material to impregnate wood fibre components which are used or exposed to outside conditions like for example, wood fence components, wood siding for house, telephone pole, wooden floor components for transportation industry, etc. The paraffin acts as a water repellent, and prolongs the useful life of the wood component. The method is characterized in the manner the wood is treated to expel moisture from its surface, and in the manner in which portions of the wood fiber at the surface of the wood component are then treated to impregnate the paraffin. The present invention also concerns an apparatus for impregnating a wood component, and a wood component so produced.

BACKGROUND OF THE INVENTION

The moisture content (MC) of wood is the amount of water contained in the wood and includes the water absorbed into the wood cell walls and free water within the hollow center of the cell (the MC is expressed in percentage in weight). Most species of wood can absorb around their cell wall a maximum of 25 to 30% of water. This limit is called the fibre saturation point. That saturation point can be reached by absorbing liquid water (in exposing the wood to rain for example) or by absorbing water vapour (in exposing the wood to air having a high level of Relative Humidity (RH)). The only way to bring the MC of wood above its fibre saturation point is with excessive exposition to liquid water only coming from windblown rain, leaks, condensation, melting ice or snow, etc. When all the air in the hollow center of the cell is replaced by water, the wood is waterlogged and the MC can be as high as 200%.

Below the fibre saturation point, the amounts of water vapour which can be absorbed by wood depend on the RH and the temperature of the air. If a piece of wood is exposed for a long period of time to an environment where the air is at 70° F. with a RH of 20%, the MC of the wood will eventually reach 5.4%. If the wood is exposed to an environment condition where the temperature is 90° F. with a RH of 90%, the MC of the wood will eventually reach 19.8%. When the MC of the wood is balanced with the RH and the temperature level, it is said that the wood is at its equilibrium moisture content (EMC). This rarely happens in nature because the RH and the temperature of the environment are consistently changing, and so does the MC of the wood. It is known that the MC of wood which is exposed to outside conditions in the United State will stay between 10% to 18.5% (except for some dry areas such as in the states of Arizona, Nevada or Texas, where the MC can go as low as 4%).

Weathering is the general term used to describe the degradation of hardwood (or softwood) exposed to outside conditions (where MC of the wood will vary under the fibre saturation point). The process of degradation of the wood is activated by sunlight radiation, temperature changes, washing by rain, and repetitive change in moisture content of the wood. This degradation occurs mainly on the surface of the wood. Swelling and shrinking stresses created by MC variations will accelerate the deterioration of the surface of the wood. Repetitive exposure of the wood to a pattern of wetting and drying causes differentiation of the wood itself and will result in many small or larger checks and cracks. Also, wood components that are warmed by the sunlight will become drier. The top surface will become drier than the rest of the board creating checks and cracks parallel to the grain of the wood.

Decay can occur only when the MC of the wood fibre is above the fibre saturation point, where fungi can develop. Wood kept consistently dry does not decay. (For more detail about physical properties of the wood, the moisture content of wood or weathering and wood decay, see "Wood Handbook: Wood as an Engineering Material", General Technical report FPL-GTR-113, United States Department of Agriculture).

Thus, it is well known in the wood industry that when the wood is exposed to outside conditions, to prevent its deterioration and increase its durability, it is necessary to control the variation of its MC. Reducing the variation of the MC of the wood will diminish the weathering effect and maintaining the MC variation of the wood under its saturation point will prevent wood decay.

When conditions of use involve environments where the MC of the wood is higher than its saturation point (like a piece of wood in underground conditions or exposed to damp conditions, where liquid water can accumulate into the wood fibre without the possibility of drying out), wood preservatives (see Table 1) can be used to impregnate the wood fibre. The purpose of those preservatives, usually chemical products, is mainly to prevent the development of fungi and thus the decay of wood.

TABLE 1

| Examples of wood preservatives commonly used for pressure-treated impregnation |
|---|
| Acid Copper chromate |
| Ammoniacal copper borate |
| Ammoniacalcopper arsenate |
| Chromated copper arsenate (CCA) |
| Chromated zinc arsenate |
| Chromate zinc chloride |
| Oxine copper |
| Copper naphthenate |
| Fluor chrome arsenate phenol |
| Pentachlorophenol |
| AWPA P9 (heavy petroleum) |
| Tributytin oxide |

This list is not exhaustive and does not include all wood preservatives which can be used. Because of environmental concerns, most of those products cannot be used for public commercial applications anymore. For some industrial applications like telephone poles or cross ties for railroads, the use of those wood preservatives is still tolerated but it is anticipated that this use will be eventually phased out.

When conditions of use involve environments where the MC of the wood is mainly under the saturation points like outside conditions, exterior finish products for wood can be used to prevent the weathering effect and/or restrain the wood from taking excessive moisture. There are two types of exterior finishes (the word finish is use in a sense of protection instead of aesthetic) for wood: those which mainly penetrated wood and those which mainly formed a film at the surface of the wood. Penetrating finishes are generally a kind of water repellent. The term "water repellent" is a generic name for a wide variety of sealers and wood treatments that change the surface properties of wood so the wood sheds liquid water and retards the absorption of the water into the wood fibre. They inhibit the absorption of liquid water during rain, yet allow the wood to dry after exposure to rain. By controlling the moisture variation inside the wood, water repellents reduce the weathering effect and/or reduce the risk of wood decay. Water repellents exist in different formulations. They usually contain a small amount of wax, or a resin with a solvent such as turpentine or mineral spirit, but are also available in a wide range of other solvent systems including waterborne formulations. There is also a water repellent product that uses paraffin oil as the solvent. This last product penetrates wood like solvent-borne formulations and the oil helps improve water repellence. A fungicide (such a3-iode-2propynyl butyl carbamate) can be added to a water repellent to prevent fungi from growing and wood from decaying.

Known in the art is U.S. Pat. No. 3,928,677 to Anthony. There is described a process for treating wood by placing the wood in a bath of hydrocarbon, petrolatum or paraffin to a temperature which expels the moisture and other gases from the wood products. Then, the wood is cooled to fill the pores with the petroleum substance. The process uses two separates baths for the wood. The first one is heated to a temperature between 140° C. and 180° C., and the second one is heated to a temperature of between 70° C. and 75° C. The wood is placed in the first bath to degas the wood, and then removed from the first bath and placed in the second bath to permit impregnation of the petroleum product therein. The heating and cooling times are dependent on the size of the piece of wood and its initial moisture content. Of course, the reader will appreciate that Anthony is directed to improving the burning qualities of the wood.

SUMMARY OF THE INVENTION

It is an object of the present invention to provide a process to treat wood to provide a more efficient protection against weathering effects.

In accordance with one aspect, the invention proposes to use a 100% solid form of paraffin (called paraffin wax) to provide a more efficient protection against weathering effects. Paraffin wax is a hydrophobic substance and once it is impregnated into the wood, it makes the wood hydrophobic. Paraffin wax is not soluble in water and will provide an efficient protection against water and moisture to wood components which are exposed to outside rainy or high moisture conditions. Paraffin wax is also solid at the ambient temperature and cannot be washed out easily, and will affix itself to the wood fiber more efficiently than any other liquid water repellent product.

Thus, another aspect of the invention provides a method of impregnation to be able to produce wood components with surface impregnation by paraffin wax. The result is an effective and low cost method to impregnate the surface of any wood component used in a wide range of applications such as for the housing industry (windows, door components, siding, carpenter wood components, beams, outside decking, wooden fences, etc), the transport industry (for laminated wooden floors in trailer and/or containers), the recreational industry (wooden playgrounds for kids) or any application where wooden components are exposed directly or indirectly to outside conditions.

In accordance with one aspect of the invention there is provided a method for treating a piece of wood to impregnate the piece of wood with a water repellent wherein said water repellent is solid at ambient temperatures, the method comprising the steps of:

(a) providing a piece of wood to be treated;
(b) heating said piece of wood for a predetermined period of time, said piece of wood being heated at a temperature A;
(c) subsequently immersing at least a portion of said piece of wood in a bath of liquefied water repellent, said bath being at a temperature B, for a predetermined period of time;
(d) thereafter removing said piece of wood from said bath and allowing said piece of wood to cool, wherein said temperature A is above 100° C. and said temperature B is below 100° C. but above a liquefying point for said water repellent, and wherein a differential between temperatures A and B is at least 60° C.

In accordance with another aspect of the invention, there is a provided an apparatus for treating a piece of wood with a water repellent, said water repellent being solid at ambient temperature, wherein said apparatus includes:

(a) a holding area for holding a plurality of pieces of wood and for dispensing said pieces of wood one at a time;
(b) a heating area for heating at least a portion of said piece of wood, said heating area being maintained at a temperature A;
(c) a bath containing a liquefied water repellent, said bath being maintained at a temperature B;
(d) a cooling area for cooling said pieces of wood;
(e) a conveyor for conveying said pieces of wood from said holding area towards and through said heating area; and through said bath into said cooling area; and
(f) a controller for controlling operation of said conveyor, for controlling said temperatures A and B, wherein said temperature A is above 100° C.

said temperature B is below 100° C. but above a liquefying point of said water repellent;

a differential between temperatures A and B is at least 60° C.;

said portion of said piece of wood that is heated is the only portion of said piece of wood that is placed in said bath.

In accordance with yet another aspect of the invention, there is provided a piece of wood treated with a water repellent, said water repellent being solid at ambient temperature, said piece of wood being surface treated with said water repellent on only a portion thereof, said portion being generally a surface of said piece of wood having a length l located at an end of said piece of wood.

BRIEF DESCRIPTION OF THE FIGURES

The present invention will be better understood after having read a description of preferred embodiments thereof, made in reference to the following drawings in which.

DESCRIPTION OF PREFERRED EMBODIMENTS OF THE INVENTION

Figure 1:
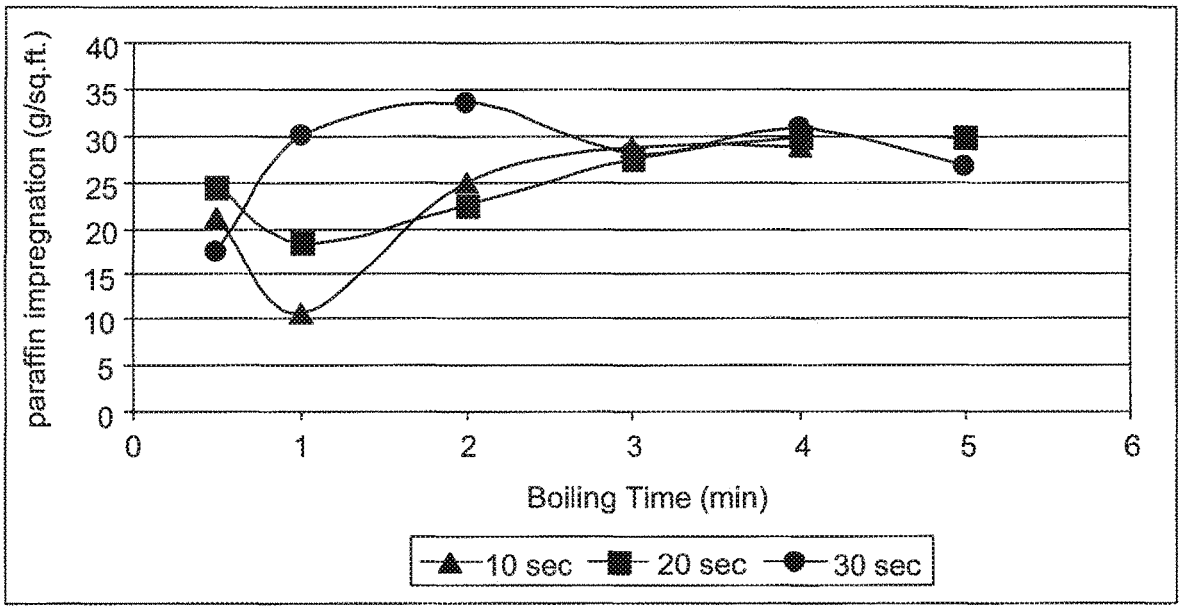
FIG. 1 is a graph showing the quantity of paraffin impregnated into a piece of wood as a function of time.

As described above, a two-step process for treating the wood is well known. However, one of the disadvantages of using two basins filled with liquid for treating the wood lies in the fact that the first basin often produces odours and volatile organic compounds (VOCs), which are generally undesirable. Additionally, there is some degree of contamination of the second basin by residues coming from the first basin, even though the piece of wood is allowed to drip before being plunged in the second basin.

Thus, one aspect of the invention provides that instead of heating the piece of wood in a liquid basin, the piece of wood is heated by direct or indirect means. For example, the entire piece of wood can be placed in an oven, or alternatively, if only a portion of the piece of wood is to be impregnated, then a hot plate can be used to heat only the portion of the piece of wood. The heating process using direct or indirect heat has the advantage of preventing contamination of the paraffin bath, and does not produce odours or VOCs. Tests have shown that sources of heat as an aluminium, steel or cast-iron (i.e. a "dry" heating) heated plate, heated by electrical elements or by water steam are more efficient. Surprisingly, this configuration seems to be more effective when a flat section of a wooden component needs to be impregnated, such as wood planks. Applicant has also found that if the portion of the piece of wood to be heated has a shape different from a flat surface, it is advantageous that the heating element has a shape adapted to conform thereto, inasmuch as possible, in order to provide a better contact between the heating plate and the piece of wood.

Once the wood surface has been sufficiently heated it is then soaked in the basin containing the water-repellent agent. The heating process according to the invention does not necessarily dry out the piece of wood. The process actually takes advantage of the moisture content of the piece of wood. The wood is heated at a temperature above the boiling point of water, in order to create steam. Obviously, a portion of the steam created will exit the piece of wood. However, the processing times are such that moisture remains in the piece of wood, albeit expanded in terms of volume due to the heating process.

For the purposes of the description of the process, assume that the wooden component is heated for 60 seconds. After the heating step, the wood component is transferred into the liquefied paraffin.

The second step of the process is a soaking into a bath of paraffin wax which has been liquefied by heat. Paraffin wax is solid at ambient temperature but when heated to a temperature of between 55° C. and 65° C., it is liquefied. The liquefied temperature of the paraffin wax must be lower than that of the oven and lower than the evaporation point of water.

The liquefied paraffin wax will penetrate into the wood because of the depression created by the condensation of the water vapour created in the first step. One important aspect of the process is that the temperature in the first step exceeds 100° C. (boiling point of water) and that the temperature in the second step be lower than 100° C. It should be noted that the greater the temperature differential, the better penetration of the paraffin wax in the wood is obtained. It has been found by the Applicant that a differential of at least 60° C. provides the best results.

For the purposes of the description of the process, assume that the wood component stays in the liquefied paraffin wax for 30 seconds. The wooden component is then removed from the liquefied paraffin to drain off the excess and cool down the wood component back to ambient temperature. The process is now over and with theses temperature and cycle time, the wooden component is impregnated by approximately 30 grams of paraffin per square foot, with a penetration of between 0.05" to 0.10" deep. The reader will appreciate that the treatment disclosed in the present invention is essentially a surface treatment. Although longer processing times, greater heat differential, and other factors would result in deeper penetration, or even thinner pieces of wood, the process of the present invention is primarily but not exclusively concerned with treated the surface of the piece of wood.

The heating time of the wood and the impregnation time of the wood in the liquefied paraffin wax have a direct effect on the quantity of liquefied paraffin wax which penetrates into the wood and the depth of the impregnation. The longer the wooden component is heated and impregnated in the liquefied paraffin wax, the deeper the impregnation and the higher the quantity of liquefied paraffin going into the wood. FIG. 1 shows the quantity of paraffin wax impregnated obtained during testing for different heating times and impregnation times.

Other factors like the variability of the physical characteristic of the wood will influence the relation. For example, the porosity, the density, the species, etc. of the wood will have an effect on the impregnation depth and quantity.

Finally, additive agents can be added to the liquefied paraffin wax to provide superior physical properties. Anti UV ingredients can be added to make the surface of the wood more UV resistant. Wood preservatives can also be added to provide fungus protection to prevent decay. Finally, colorants can be added to change the color of the wood component.

The invention provides an innovative treatment to reduce the weathering effects for wooden components which are exposed to outside conditions. The paraffin wax used to treat the wooden component is an effective liquid and vapour water repellent, uses an inexpensive raw material (less than 10 cents per square foot), is not easy to wash out contrary to when liquid water repellents are used, and it is harmless for humans and the environment (the paraffin wax is the same product used to make candlesticks or the wax used to seal fruit jams and preserves). The manufacturing process is simple and does not require a major investment to realize. Finally, additives can be added to the liquefied paraffin to increase its UV resistance, or to color the paraffin or to prevent the fungus proliferation to reduce decay.

Thus, a first aspect of the invention lies in heating a piece of wood in order to trigger a degassing process, so that the MC of the wood is lowered, and then subsequently impregnating the piece of wood in a basin of liquefied paraffin, so that the paraffin penetrates into the pores of the now-dry wood. As mentioned above, the wood can also be treated with anti-UV agents, pesticides, and other wood preservatives.

In some applications however, although impregnation of the entire piece of wood is a logical step, it is not always necessary. To Applicant's knowledge, a process has not been proposed to allow impregnation of only a portion of a piece of wood, and a piece of wood treated on only a portion thereof has not been suggested or taught in the prior art. Advantages of heating and subsequently treating only a portion of the piece of wood are non-negligible: reduced energy consumption at the heating stage, reduced heating times resulting in greater efficiency, reduced quantity of is impregnated with paraffin used which has as its corollary less energy used to heat the paraffin, all of which results in ultimate cost savings to the end user.

Thus, the present invention also provides an apparatus for treating a piece of wood. Although the expression "apparatus" is used, it should not be implied that the equipment used is monolithic. Indeed, the "apparatus" is not a single equipment, but rather an assembly of various components, as will be explained hereinafter.

The method of the present invention finds particular use in the fabrication of wooden floors for the trailer industry. For these wooden floors, although treating the entire floor either on its top surface, or on its top and bottom surfaces, may be logical, it is for most cases superfluous. Indeed, the portion of the floor that requires treatment is the rear portion, typically the last 50-100 inches, and preferably the last 72 inches. Clearly, processes that treat the entirety of the piece of wood described in the prior art cannot easily be converted to such an application.

More specifically, in applications such as wood used for flooring in trailers, it is advantageous to treat only the rear of the floor, and that only for a given length. In such cases, the floor is made of a plurality of planks of wood, each of these being in turn made of a plurality of wood sticks aligned end to end and side by side in order to form a plank. Such wood floors are well known in the art.

Figure 5:
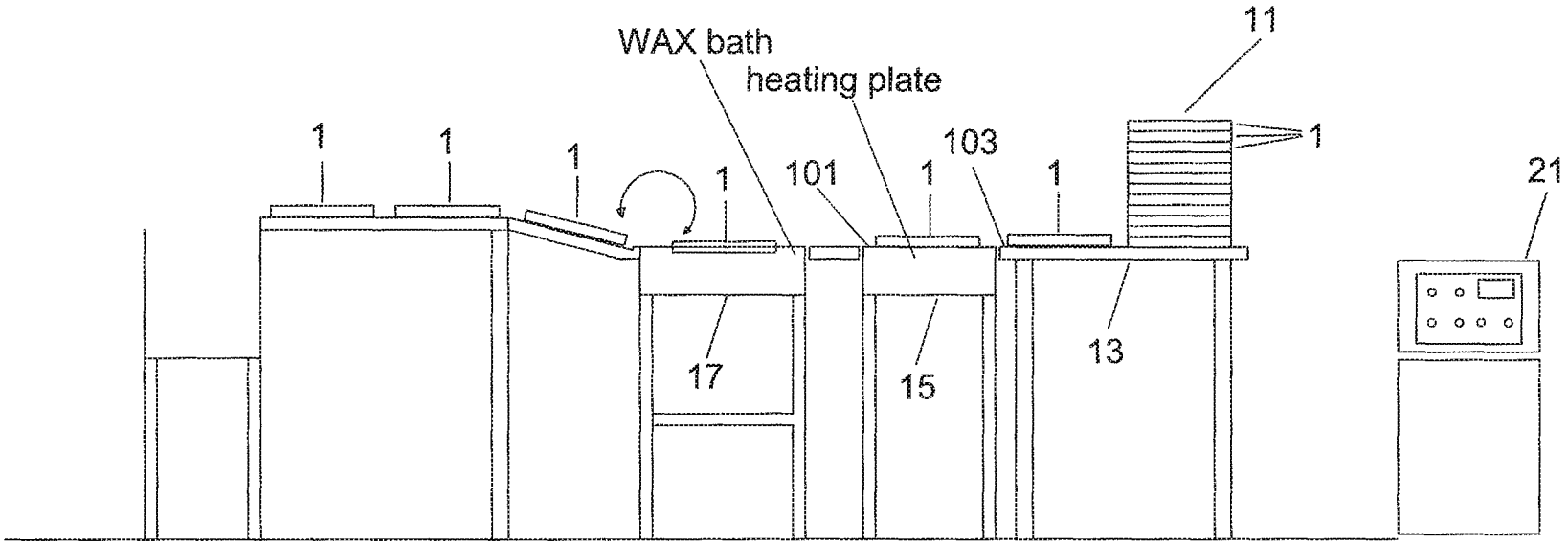
FIG. 5 is a view taken along lines V-V of FIG. 4.

Thus, the apparatus 10 or installation of the present invention contemplates a loading area 11, for holding a plurality of wood planks 1, illustrated in FIG. 5. Such wood planks are typically 16 to 50 feet in length, and 6 to 14 inches wide, and of a given thickness. A conveyor or rolling transfer 13 takes individual planks one at a time and conveys each plank transversely. The conveyor 13 conveys the planks over a heating area 15, the heating area 15 being adapted to heat only the portion of the wood plank that will be ultimately treated. Once the plank 1, or portion thereof, has been heated, the wood plank 1 is then conveyed to a basin 17 containing the paraffin. The plank 1 passes through the basin 17 in order to be impregnated with the paraffin. The plank then exits the apparatus and is left to cool.

A control system 21 controls the speed at which the planks are conveyed, the heat of the heating area, the heat of the basin, in order to optimize the treatment according to the desired result.

As mentioned above, the heating area 15 preferably consists of a heating plate. Preferably, the top surface 101 of the heating plate is flush with the top surface 103 of the area defined by the conveyor, so that as the plank is conveyed from the loading area to the heating area, the bottom surface of the plank directly contacts the top surface of the heating plate.

As mentioned above, another aspect of the invention concerns a method by which only a portion of a piece of wood is impregnated with paraffin.

In accordance with this aspect, the piece of wood to be treated is preferably inclined by a calculated angle, in order to treat dip into the basin a desired length of the piece of wood, without exceeding a predetermined soak depth.

Figure 2:
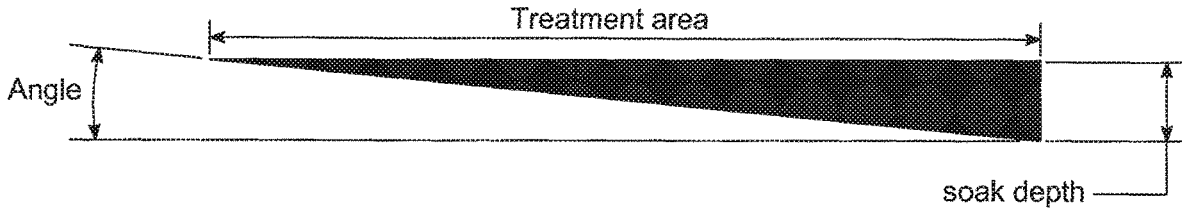
FIG. 2 is a schematic representation of impregnation of a portion of a piece of wood according to an embodiment of the invention.
Figure 3:
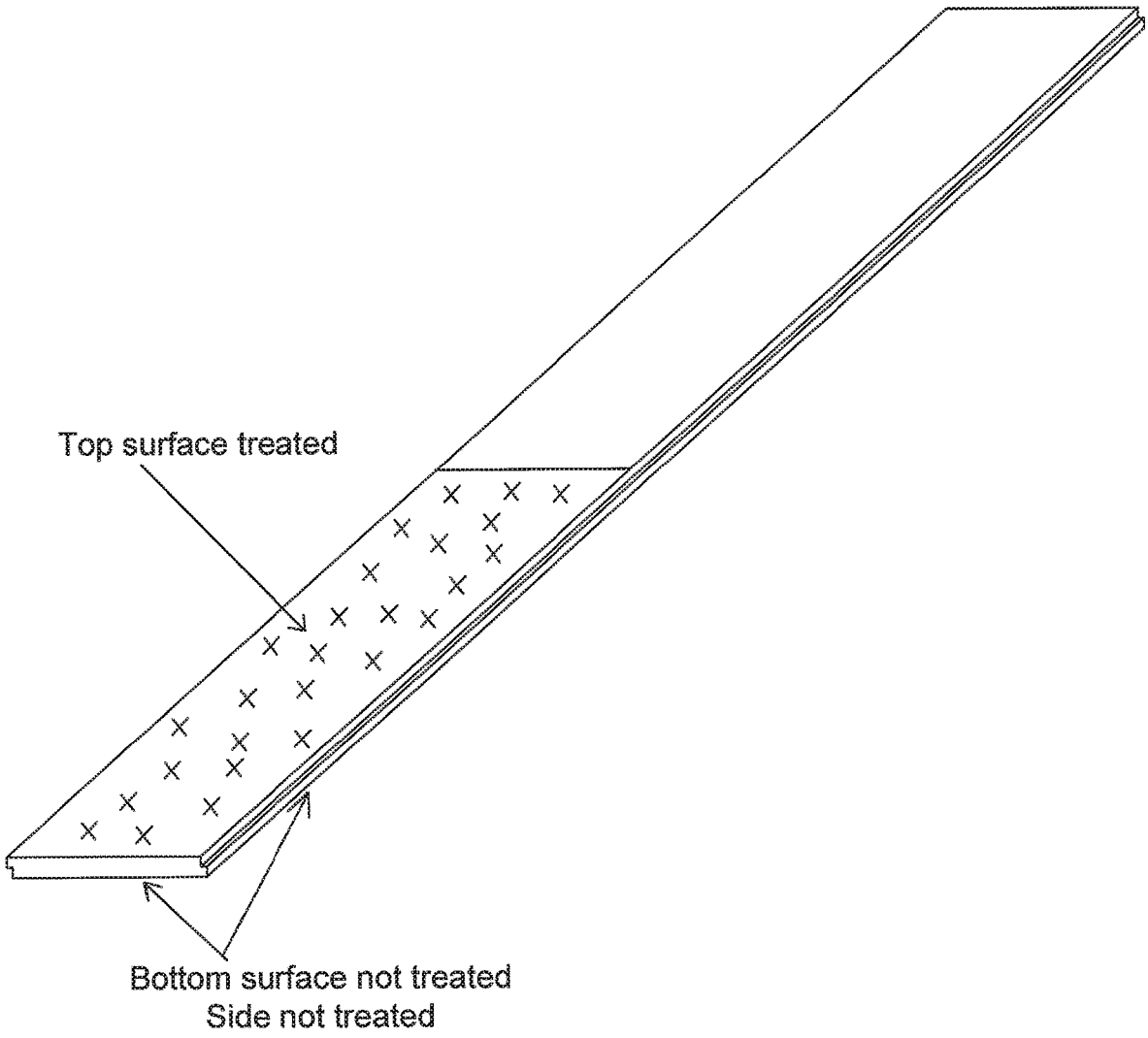
FIG. 3 is a schematic representation of a plank of wood treated according to a preferred embodiment of the invention.
Figure 4:
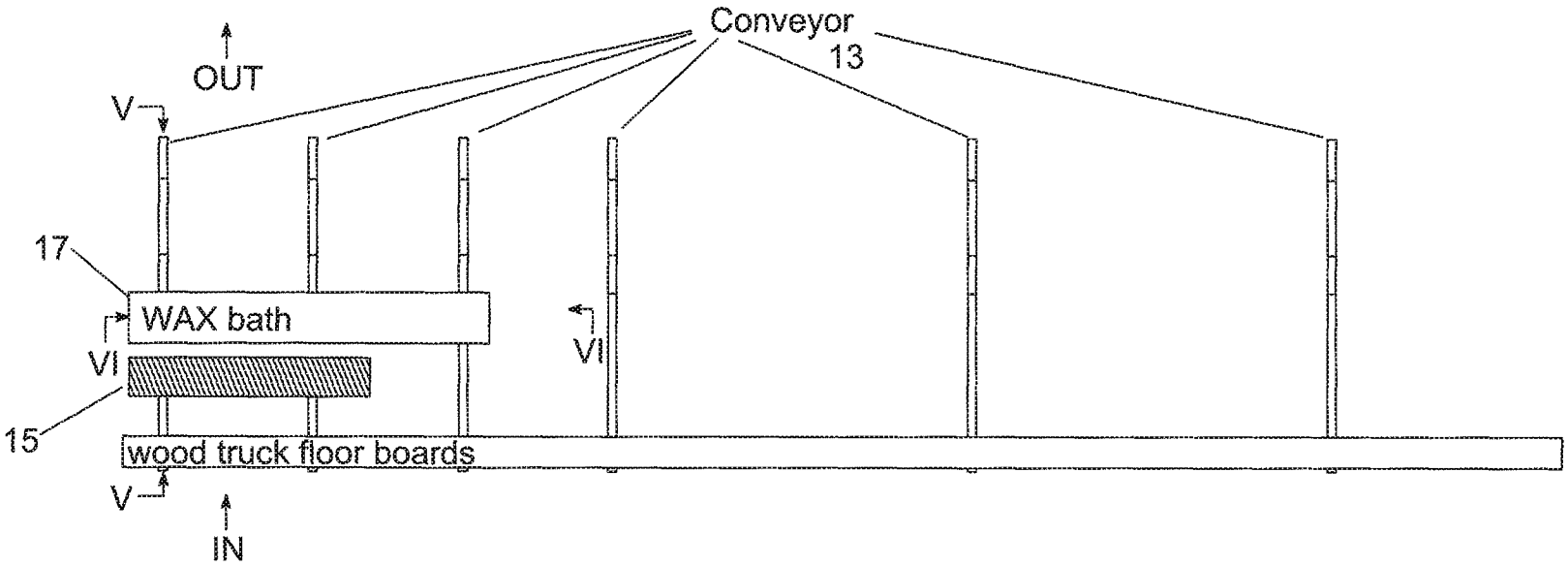
FIG. 4 is a top view of an installation for carrying out the process of the present invention.
Figure 6:
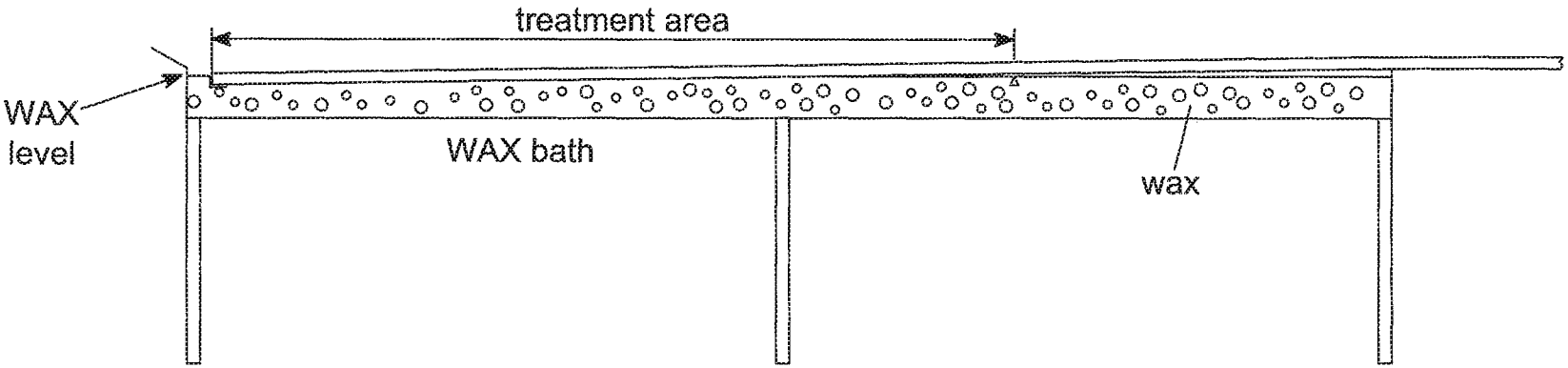
FIG. 6 is a view taken along lines VI-VI of FIG. 4.

In wood floors for the trailer industry, it is desirable to treat only one surface of the wood plank, for a predetermined length such as 72 inches. FIGS. 2 and 6 show how the piece of wood is placed in the paraffin basin. Of course, allowance must be made for the difference in height between the lip of the basin and the surface of the liquid paraffin in order to properly position the piece of wood.

Once the length of the treatment area and the soak depth are determined, the inclination angle of the floor can be determined.

For example, if we want to protect the last 72 inches of the piece of wood, the following calculation is made:

$$\text{Angle}=\tan^{-1}(\text{soak depth/length of the treatment area})$$

$$\text{Angle}=\tan^{-1}(0.625''/72'')$$

$$\text{Angle}=0.4973 \text{ degrees}$$

The soak depth is predetermined, and can be adjusted according to the requirements of the application. For example, a trailer used in climates where the rear of the floor of the trailer will be exposed to the elements, such as rain and snow, may require a deeper soak depth than a trailer used in warmer climates.

Thus, the apparatus according to the present invention includes a subsystem for inclining the wood plank as is enters the basin, so that the required portion of the plank is dipped into the basin. This subsystem is adjustable, in order to provide more or less inclination. In one embodiment, the subsystem is essentially a mechanism for raising the end of the plank opposite the end to be treated, and pivoting the plank about an axis parallel to the direction of travel of the plank. Of course, other mechanisms for introducing the wood plank portion to be treated will meet the objects of the invention.

Finally, as shown in FIG. 5, the piece of wood 1 exits the paraffin basin. Preferably, wood plank 1 is flipped to that the treated portion now faces upwards. Then, the piece of wood 1 is inclined in order to permit excess paraffin to run off. This last portion of the process may further include blowing hot air towards the treated surface to prevent solidifying of the paraffin too quickly and ease the runoff. Further advantageously, a squeegee can be used to wipe the treated area from excess paraffin.

Although the present invention has been explained hereinabove by way of a preferred embodiment thereof, it should be pointed out that any modifications to this preferred embodiment within the scope of the appended claims is not deemed to alter or change the nature and scope of the present invention.

The invention claimed is:

1. A method for treating a piece of wood to impregnate only a portion of the piece of wood with a water repellent, said portion being smaller than said piece of wood, wherein said water repellent is solid at ambient temperatures, the method comprising the steps of:

(a) providing said piece of wood to be treated;

(b) dry heating said piece of wood for a predetermined period of time, said piece of wood being heated at a temperature A;

(c) subsequently immersing only said portion of said piece of wood in a bath of liquefied water repellent, said bath being at a temperature B, for a predetermined period of time;

(d) thereafter removing said piece of wood from said bath and allowing said piece of wood to cool, wherein said temperature A is above 100° C. and said temperature B is below 100° C. but above a liquefying point for said water repellent, and wherein a differential between temperatures A and B is at least 60° C.

2. A method according to claim 1, wherein said piece of wood is in the shape of a plank, and wherein said portion of said piece of wood that is immersed is a length 1 of a surface of said plank at a maximum depth d.

3. A method according to claim 2, wherein said piece of wood is immersed in said water repelling solution at an angle determined by said length 1 and said depth d.

4. A method according to claim 2, wherein said bath of water repelling solution is liquid paraffin.

5. A method according to claim 2, wherein said water repellent bath further includes at least one additive.

6. A method according to claim 5, wherein said at least one additive is selected from the group consisting of anti-UV additives, wood preservatives and colorants.

7. A method according to claim 1, wherein said method further includes a step of wiping off excess paraffin from said piece of wood after exiting said bath.

8. A method according to claim 1, wherein said method further includes a step of providing a conveyor for conveying said pieces of wood from a holding area, towards and through said heating area and said bath.

* * * * *